United States Patent [19]

Wilkes

[11] Patent Number: 4,644,764

[45] Date of Patent: Feb. 24, 1987

[54] TAIL SHORTENER FOR CYLINDER AND DIAL KNITTING MACHINES FOR KNITTING RIBBED SOCKS

[76] Inventor: Louis H. Wilkes, 28 Center St., Seneca Falls, N.Y. 13148

[21] Appl. No.: 743,400

[22] Filed: Jun. 11, 1985

Related U.S. Application Data

[63] Continuation of Ser. No. 535,154, Sep. 23, 1983, abandoned.

[51] Int. Cl.[4] ..... D04B 15/61

[52] U.S. Cl. ..... 66/140 S

[58] Field of Search ..... 66/134, 140 R, 140 S, 66/145 R, 145 S

[56] References Cited

U.S. PATENT DOCUMENTS

| | | | |
|---|---|---|---|
| 1,641,101 | 8/1927 | Scott | 66/24 |
| 3,197,977 | 8/1965 | Stack | 66/140 S |
| 3,234,761 | 2/1966 | Stahl et al. | 66/140 S |
| 3,340,707 | 9/1967 | Currier | 66/95 X |
| 3,654,778 | 4/1972 | Minton | 66/145 S |
| 3,714,799 | 2/1973 | Minton | 66/140 S |

*Primary Examiner*—Wm. Carter Reynolds

*Attorney, Agent, or Firm*—Stonebraker, Shepard & Stephens

[57] ABSTRACT

A tail shortener is applied to cylinder and dial circular knitting machines for knitting ribbed socks so as to shorten the yarn tails that would otherwise occur on each yarn change. The upper flange periphery 17 of the dial 15 is formed with uniform yarn catching notches 16 arranged between slots 18 for dial hooks and cast-offs. A yarn lead-in surface 13 is formed in the outer periphery of the dial head 10' above the dial flange 17, and yarn lead-in surface 13 is located rotationally beyond yarn feed fingers 22 to extend inward of the radially inner extremities of yarn catching notches 16 in dial 15. A yarn cutter 30 mounted on dial head 10' near lead-in surface 13 is urged against upper flange 17 of dial 15 and arranged so that yarn catching notches 16 run under yarn cutter 30. These components are arranged so that each yarn change causes yarn tails to be drawn radially inward adjacent lead-in surface 13 where notches 16 catch each yarn tail near the needle 21 holding the yarn closest to the yarn tail so that each caught yarn is cut in passing under cutter 30, resulting in yarn change tails cut short enough to eliminate picking and clipping.

17 Claims, 8 Drawing Figures

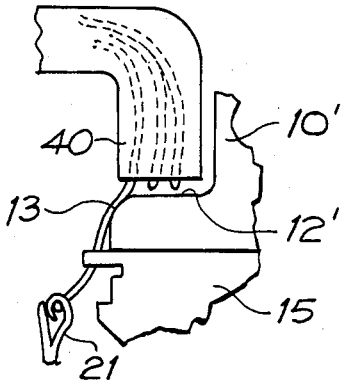
Fig. 4
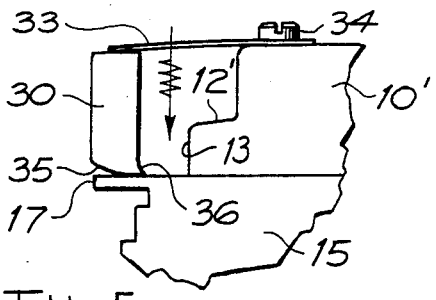
Fig. 5
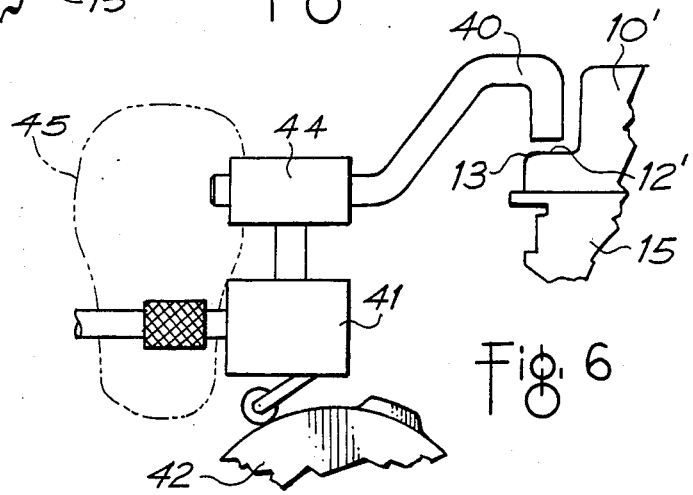
Fig. 6
Fig. 7
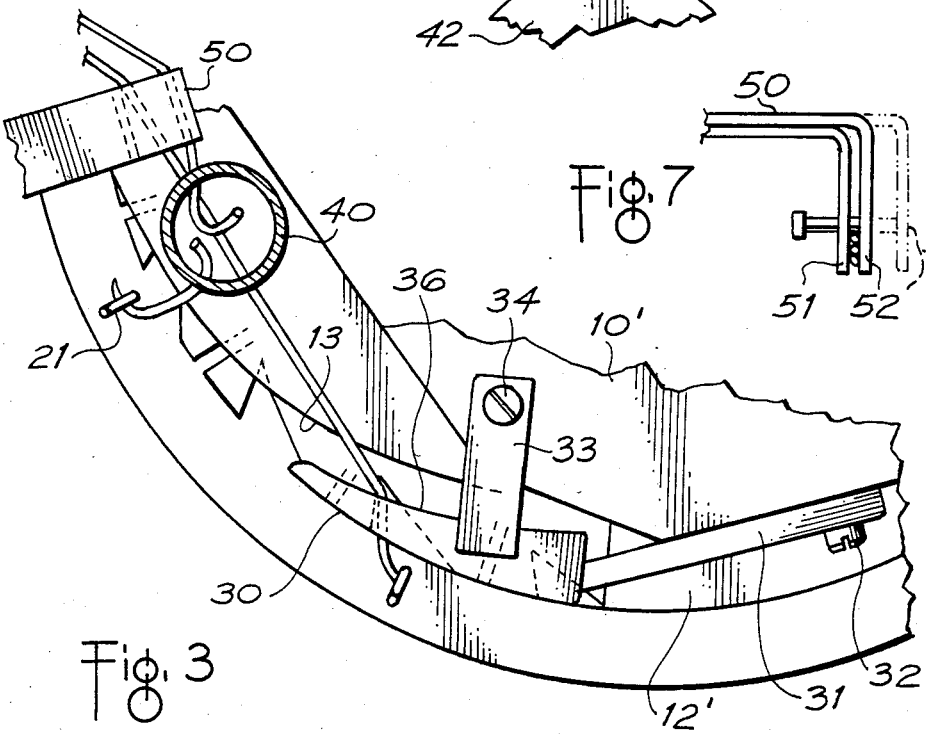
Fig. 3

TAIL SHORTENER FOR CYLINDER AND DIAL KNITTING MACHINES FOR KNITTING RIBBED SOCKS

RELATED APPLICATIONS

This application is a continuation of my parent application Ser. No. 535,154, filed Sept. 23, 1983, entitled TAIL SHORTENER FOR CYLINDER AND DIAL KNITTING MACHINES FOR KNITTING RIBBED SOCKS, and abandoned upon the filing of this continuation application.

BACKGROUND

Ribbed socks are knitted on circular knitting machines that have a dial and dial head operating dial hooks and cast-offs to cooperate with cylinder needles in forming different ribbing patterns. Ribbed socks can also have stripes or different colored heels and toes, and each color change requires a yarn change. Every yarn change produces a pair of tails that are 5–8 cm lengths of yarn extending loosely from the last stitch holding the yarns in place. These yarn tails are knitted randomly into the socks where they are caught within other stitches. They make the socks look disorderly and unattractive, so it has been necessary to manually pick the tails clear of other stitches and clip the tails off short so that the socks look neat. This is boring work that adds to the cost of the socks, because one worker can pick and clip only a few socks per minute, depending on the number of yarn changes.

I have discovered a simple and effective way to shortening the tails formed in cylinder and dial machines for knitting ribbed socks. I modify the machines so that each yarn change tail is shortened to about 4–8 mm so that it is not knitted into the sock and does not need to be picked and clipped. My discovery can be applied to a cylinder and dial knitting machine by making a few low cost changes that do not impair the machine's operation. In fact, my changes liberate machine components otherwise devoted to yarn changes and allow addition of more yarn feed fingers and greater variation in colors and yarns usable for knitting ribbed socks. The result enlarges freedom of design and lowers production costs by eliminating picking and clipping of tails.

SUMMARY OF THE INVENTION

My tail shortener applies to cylinder and dial circular knitting machines for knitting ribbed socks. Such machines have a dial with radial slots for dial hooks and cast-offs and a dial head arranged over an upper flange of the dial for operating the dial hooks and cast-offs as the dial rotates.

I form the radially outwardly extending upper flange periphery of the dial with uniform yarn catching notches arranged between the slots for dial hooks and cast-offs. I also form a yarn lead-in surface in an outer periphery of the dial head and locate the lead-in surface rotationally beyond the yarn feed fingers to extend slightly inward of the radially inward extremities of the yarn catching notches. I mount a yarn cutter on the dial head near the lead-in surface so that the yarn catching notches run under the yarn cutter, which is urged against the upper flange of the dial.

The lead-in surface and yarn cutter on the dial head are arranged so that each yarn change causes yarn tails to be drawn radially inward adjacent the lead-in surface where the notches catch each yarn tail near a needle holding the yarn closest to the yarn tail. Each caught yarn is then cut in passing under the cutter, resulting in yarn change tails cut short enough to eliminate picking and clipping.

DRAWINGS

FIG. 3 is a partially schematic, enlarged, fragmentary view of the tail shortening region of a cylinder and dial knitting machine modified according to my invention;

FIG. 4 is a partially schematic, fragmentary, side, elevational view of the suction tube region of the tail shortening system shown in FIGS. 2 and 3;

FIG. 5 is a partially schematic, fragmentary view of the yarn cutter portion of the tail shortening system of FIGS. 2 and 3;

FIG. 6 is a partially schematic, side elevational view of a way of applying suction to the suction tube of FIGS. 3 and 4; and FIG. 7 is a fragmentary, side elevational view of a preferred yarn binder for the tail shortening system of FIGS. 2 and 3.

DETAILED DESCRIPTION

Figure 1:
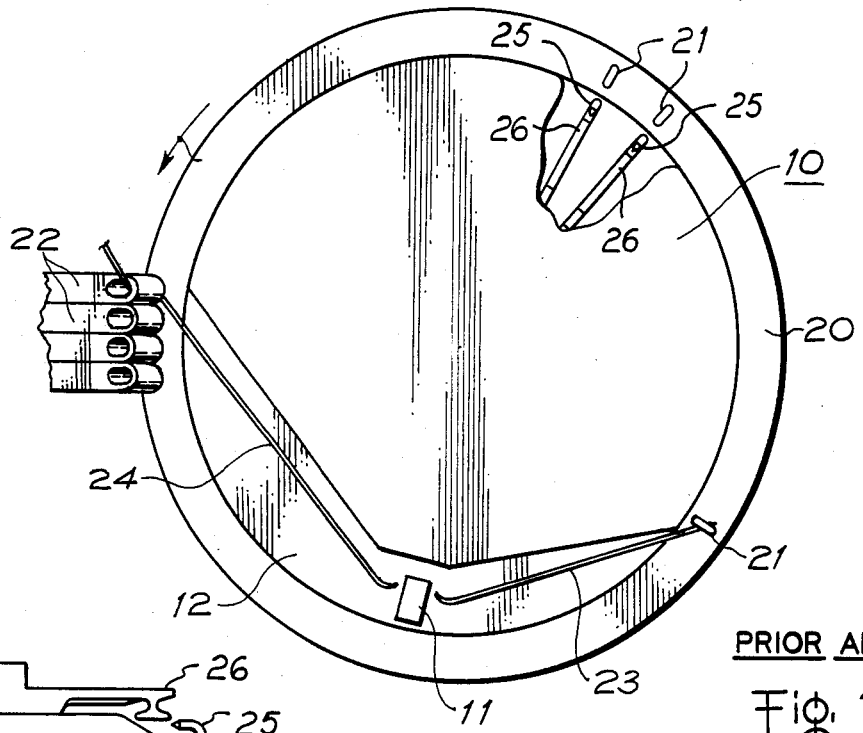
PRIOR ART Fig. 1
FIG. 1 is a partially schematic plan view of a prior art cylinder and dial knitting machine that produces long yarn change tails that are shortened by my invention and that includes prior art dial hooks and cast-offs omitted from the views of FIGS. 2–6 to simplify the illustration of the invention.
Figure 1A:
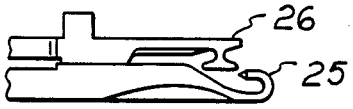
PRIOR ART Fig. 1A
FIG. 1A is a fragmentary side elevational view of prior art dial hooks and cast-offs illustrated in plan view in FIG. 1 and otherwise omitted from the views of FIGS. 2–6 to simplify the illustration of the invention.

Two yarn tails, each 5–8 cm long, are produced on each yarn change in a prior art cylinder and dial circular knitting machine for knitting ribbed socks as shown in FIG. 1. A fixed dial head 10 conceals an underlying dial that rotates immediately under dial head 10 along with cylinder 20 carrying knitting needles 21. The dial and dial head are the same diameter, and they work together to operate dial hooks and cast-offs that cooperate with knitting needles 21 to knit ribs into the socks.

Yarn feed fingers 22 feed a yarn into the sock when lowered so that needles 21 can catch the yarn as they pass under the lowered feed finger. Yarns not being knitted into the sock are elevated above needles 21 by lifted feed fingers 22

Each time a yarn leaves the sock on a yarn change, it is severed by a shear 11 mounted on dial head 10 and actuated by levers that are not shown. A length of departing yarn between the last needle 21 holding the yarn and the raised yarn feed finger that lifted the yarn clear of needles 21 is drawn into shear 11 after the last needle 21 stitching the yarn into the sock has passed well beyond shear 11. When this happens, shear 11 actuates to cut the yarn, leaving a long yarn tail 23 trailing the last stitch for that yarn and another long yarn tail 24 leading the yarn when it next enters the sock. Trailing tail 23 follows loosely behind its last stitch and is randomly knitted into other stitches from which it must later be picked out and clipped off.

Lead-in tails 24 are held by a binder (not shown in FIG. 1) until their respective yarns reenter the sock. When this happens, a yarn finger 22 lowers so that a needle catches the yarn and begins knitting it into the sock, but the lead-in tail 24 falls loose and is randomly knitted into other stitches from which it must later be picked and clipped.

Figure 2:
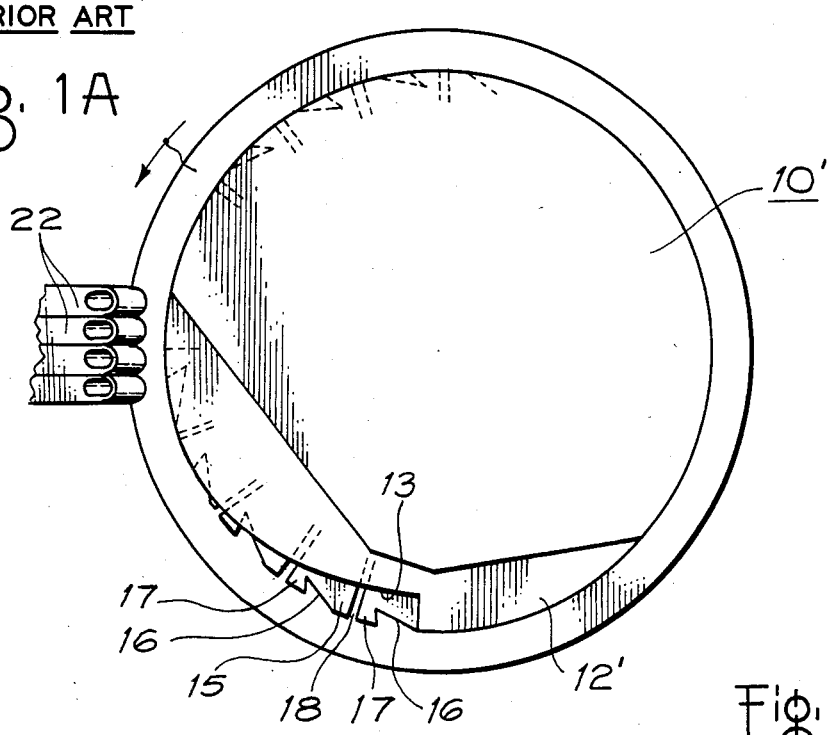
FIG. 2 is a partially schematic plan view of a dial head, dial, and cylinder of a cylinder and dial knitting machine modified according to my invention to have yarn catching notches in the dial and a yarn lead-in surface in the dial head.

My way of shortening yarn change tails involves removing prior art shear 11 and its operating mechanisms and making changes in dial head 10' and dial 15 as shown in FIG. 2. I then add a yarn cutter as shown in FIGS. 3 and 5; a suction tube as shown in FIGS. 3, 4, and 6; and preferably a simplified binder as shown in FIGS. 3 and 7. These structures will be described first, followed by an explanation of their operation.

In the region of the ledge 12' in dial head 10' rotationally beyond yarn feed fingers 22, I form a yarn lead-in surface 13 as shown in FIG. 2. Lead-in surface 13 can be formed by grinding away a portion of the outer perimeter of dial head 10' in the region of ledge 12' so that surface 13 curves inward from the previous perimeter of dial head 10' and flange 17 to open up a yarn cutting region.

I also form uniform yarn catching notches 16 in the upper flange periphery 17 of dial 15 so that each yarn catching notch 16 is arranged between slots 18 for dial hooks and cast-offs. As dial 15 rotates under dial head 10', yarn catching notches 16 are exposed in the recess formed by lead-in surface 13. There, notches 16 catch the yarn tails and cooperate with a cutter 30 to cut the tails short enough to eliminate picking and clippping.

To accomplish this, each yarn tail must be drawn into the recess along lead-in surface 13 so that it is caught by one of the notches 16. Then cutter 30 is arranged to ride on the upper surface of dial flange 17 so that notches 16 pass under cutter 30, which is shaped to cut the caught yarns. Suction tube 40 cooperates in this as does a preferably simplified binder 50.

Cutter 30 is mounted on an arm 31 secured to dial head 10' with a screw 32 so that cutter 30 has a little freedom of vertical motion. Cutter 30 is biased downward to ride on the upper surface of dial flange 17, preferably by a simple leaf spring 33 fastened to dial head 10' with a screw 34.

Cutter 30 preferably has a slightly convex foot 35 that presses against dial flange 17 so as to ride smoothly over the yarn catching notches 16 that pass under cutter 30. The radially inward facing edge 36 of cutter 30 is preferably sharpened as best shown in FIG. 5, and cutter 30 is preferably shaped to widen in the direction of rotation of dial 15 (as best shown in FIG. 3) so that sharpened edge 36 engages progressively inward regions of each yarn catching notch 16 passing under cutter 30. A yarn tail caught in a notch 16 is then forced toward the radially innermost apex of a notch as the notch and yarn slide under cutter 30. When sharpened edge 36 of cutter 30 intersects the inner apex of a notch carrying a yarn tail, it shears off the yarn. Cutting edge 36 extends radially inward slightly beyond the innermost reach of the apexes of notches 16 to ensure that every caught yarn is cut.

Suction tube 40 is positioned rotationally ahead of cutter 30 next to lead-in surface 13 and spaced slightly above ledge 12'. Suction is applied to tube 40 preferably on each yarn change to draw yarn tails into tube 40. I prefer a suction system such as schematically shown in FIG. 6 using a valve 41 operated by a cam on striper drum 42 to admit air from a pneumatic line 43 to an eductor 44 that applies suction to tube 40 during each yarn change interval. This uses less energy and is quieter than applying continuous suction to tube 40. There are other ways that suction can be applied to tube 40 during yarn change intervals, though.

I also prefer a single binder 50 operated in a generally known way except that all the available yarns are held between a single pair of binder fingers 51 and 52. Binder 50 opens in a generally known way to receive a cut off yarn leaving the sock on a yarn change and then closes to hold the unused yarns. On the next yarn change, a yarn being introduced into the sock is pulled from binder 50 which cycles open and closed to receive the next departing yarn.

In the operation of my tail shortener, there is preferably an overlap of a few stitches between a yarn entering the sock and a yarn leaving the sock. The entering yarn has its leading end drawn into suction tube 40, and this yarn is held in binder 50 waiting for its turn. As a yarn change sequence begins, the yarn feed finger 22 guiding the entering yarn drops to its lower feed position where a needle 21 on cylinder 20 catches the yarn and starts knitting it into the sock.

As this happens, the needles knitting the yarn move counterclockwise as shown in the drawings, past binder 50 where the yarn is pulled from the lower end of the binder, and past suction tube 40 holding the cut off free end of the entering yarn. Suction is applied to tube 40, preferably by a cam on striper drum 42, during the yarn change sequence.

As the needle 21 holding the yarn nearest its tail end moves past suction tube 40 and into the recessed region adjacent lead-in surface 13, the yarn tail is angled inward as best shown in FIG. 4 against lead-in surface 13 as it is pulled obliquely upward by suction tube 40. Lead-in surface 13 is rounded or vertically sloped inward to help the yarn tail angle obliquely inward. This allows the yarn catching notch 16 nearest the needle 21 holding the yarn tail to catch the yarn as it advances toward the cutter. Cutter 30 preferably engages progressively inward regions of the notch that has caught the yarn tail as the notch passes under the cutter. By the time the sharpened edge 36 of cutter 30 intersects the apex of the notch that caught the yarn tail, the cutter severs the yarn 4–8 mm from the place where it is stitched into the sock by needle 21. At this point, the opposite end of the yarn tail is still drawn into suction tube 40 so that severing the yarn near its first stitch cuts off a short length of waste yarn about 4–5 cm long. This passes up suction tube 40 and is evacuated into a collector bag 45.

Just before this sequence is completed, another yarn finger 22 lifts the yarn leaving the sock on the yarn change so that needles 21 can no longer catch the departing yarn. The last needle 21 holding the departing yarn rotates counterclockwise past binder 50 and suction tube 40 to the region of lead-in surface 13. There, because of the upward and inward inclination of the yarn leading back to its raise feed finger 22, the departing yarn is drawn inward along lead-in surface 13 where it is caught by a notch 16 adjacent the last needle 21 knitting it into the sock. Once caught in a notch 16, the departing yarn passes under cutter 30 and is cut off to leave a short tail.

At the point where the departing yarn is cut off, it extends under or closely adjacent suction tube 40 that is actuated during the yarn change interval. Tube 40 then sucks up the cut off yarn and draws its free end up into tube 40. At this time the cut off yarn is also drawn into binder 50, which closes at the end of the yarn change sequence to hold the cut off yarn whose free end has been drawn up into suction tube 40. The suction stops at the end of the yarn change sequence, leaving the unused yarns held by binder 50 with their free ends drawn into suction tube 40 to await the next yarn change.

By my yarn change operations, each yarn is cut twice—once as it leaves the sock and again as it enters the sock. The two cuts produce tails short enough so they do not have to be picked and clipped, and a waste yarn segment between the two cuts is evacuated up through suction tube 40. Prior art cylinder and dial machines for knitting ribbed socks cut each yarn only once, leaving two long yarn tails that require picking and clipping. My tail shortening operations occur at the beginning and end of each sock and for each yarn change made while the sock is knitted. Yarn changes occur for each color change, such as stripes and colored heels and toes, and for elastic yarns in a foot region of a sock. For whatever reason the yarn change occurs, the sequence is similar to the one described and produces tails shortened to about 4–8 mm lengths that are not knitted into other stitches in the socks and do not need to be picked and clipped.

Eliminating the prior art lever-operated shear allows another yarn feed finger to be added to the machine. This can accommodate an additional color yarn or elastic foot region yarn enlarging sock design possibilities.

I claim:

1. A tail shortener for a circular knitting machine for knitting ribbed socks with a cylinder having cylinder needles, with a dial having a radially extending upper flange periphery disposed closely inside said cylinder needles and having radial slots open at the top of said dial and extending to the outer perimeter of said upper flange to receive radially movable dial hooks and cast-offs, and with a dial head fixed closely above and extending to said outer perimeter of said top of said dial to move said dial hooks and cast-offs radially within said slots for knitting ribs as said dial turns, said tail shortener comprising:

a. uniform yarn catching notches formed in said upper flange periphery between said slots for said rib knitting dial hooks and cast-offs;

b. a yarn lead-in surface radially recessed into an outer periphery of said dial head so that said yarn lead-in surface opens a space above said dial flange;

c. said yarn lead-in surface being located rotationally beyond yarn feed fingers and extending inward of the radially inner extremities of said yarn catching notches;

d. a yarn cutter mounted on said dial head in the region of said lead-in surface and biased against a top surface of said dial flange;

e. said yarn cutter extending along said outer perimeter of said dial flange for a sufficient extent to span and ride over said slots and said yarn catching notches; and f. said lead-in surface and yarn cutter on said dial head being arranged so that each yarn change causes yarn tails to be drawn radially inward adjacent said lead-in surface where said notches catch each yarn tail near a cylinder needle holding the yarn closest to the yarn tail and each caught yarn is cut in thereafter passing under said cutter, resulting in yarn change tails cut short enough to eliminate picking and clipping.

2. The tail shortener of claim 1 wherein said cutter has a convex bottom and is shaped and oriented to engage progressively inward regions of each notch passing under said cutter.

3. The tail shortener of claim 2 wherein said cutter has a sharpened edge facing radially inward and positioned within said outer perimeter of said flange.

4. The tail shortener of claim 1 including a spring and a pivotal cutter mount arranged for biasing said cutter against said flange.

5. The tail shortener of claim 1 including a suction tube arranged in the region of said lead-in surface ahead of said cutter for drawing in said yarn tails by means of a suction applied to said suction tube during each yarn change interval.

6. The tail shortener of claim 1 including a binder arranged in the region of said lead-in surface ahead of said cutter for holding yarns not being knitted into said sock.

7. The tail shortener of claim 6 including a suction tube arranged between said binder and said cutter for drawing in said yarn tails by means of a suction applied to said suction tube during each yarn change interval.

8. A method of shortening yarn change tails in a circular knitting machine for knitting ribbed socks with a cylinder having cylinder needles, with a dial having a radially extending upper flange periphery disposed closely inside said cylinder needles and having radial slots open at the top of said dial and extending to the outer perimeter of said upper flange to receive radially movable dial hooks and cast-offs, and with a dial head fixed closely above and extending to said outer perimeter of said top of said dial to move said dial hooks and cast-offs radially within said slots for knitting ribs as said dial turns, said method comprising:

a. notching said upper flange periphery between each of said slots;

b. radially recessing said dial head to form a yarn lead-in surface opening a space above said dial flange radially inward from said outer perimeter;

c. running a cutter against the top surface of said upper flange periphery to ride over said slots and notches and intersect apexes of said notches; and d. catching each yarn change tail in one of said notches adjacent said lead-in surface for cutting off each tail close to the sock as the caught yarn passes under said cutter.

9. The method of claim 8 including suctioning away cut off yarn change tails by means of a suction actuated during each yarn change interval.

10. The method of claim 8 including sharpening said cutter along a radially inwardly facing edge of said cutter so that apexes of said notches move toward said edge as said cutter rotates.

11. The method of claim 8 including forming said cutter with a convex bottom shaped and oriented to engage progressively inward regions of each of said notches passing under said cutter.

12. The method of claim 11 including sharpening an edge of said cutter facing radially inward and positioned within said outer perimeter of said flange.

13. A method of shortening yarn change tails for a circular knitting machine for knitting ribbed socks with a cylinder having cylinder needles, with a dial having a radially extending upper flange periphery disposed closely inside said cylinder needles and having radial slots open at the top of said dial and extending to the outer perimeter of said upper flange to receive radially movable dial hooks and cast-offs, and with a dial head fixed closely over and extending to said outer perimeter of a top surface of said dial to move said dial hooks and cast-offs radially relative to said cylinder needles for knitting ribs as said dial turns, said method comprising:

a. forming said dial as a yarn change catcher by forming a yarn catching notch between each of said slots in said upper flange periphery of said dial and radially recessing a yarn lead-in surface into an outer periphery of said dial head to open a space above said dial flange radially inward of said outer perimeter of said flange;

b. catching each yarn change tail in one of said notches adjacent a cylinder needle by guiding each yarn change tail inside said outer perimeter of said flange along said lead-in surface; and c. cutting off yarn change tails caught in said notches by passing caught yarn tails under a cutter mounted adjacent said yarn lead-in surface and biased against a top surface of said upper flange periphery so that said cutter spans and rides over said slots and notches.

14. The method of claim 13 including suctioning away cut off yarn change tails by means of a suction actuated during each yarn change interval.

15. The method of claim 13 including sharpening said cutter along a radially inwardly facing edge of said cutter so that apexes of said notches move toward said edge as said cutter rotates.

16. The method of claim 13 including forming said cutter with a convex bottom shaped and oriented to engage progressively inward regions of each of said notches passing under said cutter.

17. The method of claim 16 including sharpening an edge of said cutter facing radially inward and positioned within said outer perimeter of said flange.

* * * * *